US008342651B2

(12) United States Patent
Saito et al.

(10) Patent No.: US 8,342,651 B2
(45) Date of Patent: Jan. 1, 2013

(54) INKJET RECORDING HEAD

(75) Inventors: Akiko Saito, Tokyo (JP); Masataka Sakurai, Kawasaki (JP); Yoshiyuki Nakagawa, Kawasaki (JP); Ken Tsuchii, Sagamihara (JP); Akira Shibasaki, Kawasaki (JP); Masao Furukawa, Yokohama (JP); Seiichi Kamiya, Yokohama (JP); Yusuke Imahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 380 days.

(21) Appl. No.: 12/699,708

(22) Filed: Feb. 3, 2010

(65) Prior Publication Data

US 2010/0201744 A1 Aug. 12, 2010

(30) Foreign Application Priority Data

Feb. 6, 2009 (JP) ..... 2009-026005

(51) Int. Cl.
*B41J 2/14* (2006.01)

(52) U.S. Cl. ..... 347/47

(58) Field of Classification Search ..... 347/47, 347/40, 43

See application file for complete search history.

(56) References Cited

U.S. PATENT DOCUMENTS

| | | | | |
|---|---|---|---|---|
| 6,137,510 | A | 10/2000 | Sato | |
| 6,540,335 | B2 | 4/2003 | Touge | |
| 7,370,944 | B2 * | 5/2008 | Cabal et al. | 347/65 |
| 2006/0214995 | A1 | 9/2006 | Hayakawa et al. | |

FOREIGN PATENT DOCUMENTS

| | | |
|---|---|---|
| JP | 10-146976 | 6/1998 |
| JP | 2000-158657 | 6/2000 |

* cited by examiner

*Primary Examiner* — Lamson Nguyen
(74) *Attorney, Agent, or Firm* — Canon USA Inc IP Division

(57) ABSTRACT

A liquid jet recording head includes a substrate including a plurality of discharge energy generating elements, and a plurality of ink supply ports positioned along an array direction of the plurality of discharge energy generating elements and separated from each other by beams, a plurality of ribs supported by the beams, and an orifice plate supported by the plurality of ribs, wherein the orifice plate includes discharge ports for discharging liquid droplets which enter from the plurality of ink supply ports and is provided with discharge energy by the plurality of discharge energy generating elements.

8 Claims, 11 Drawing Sheets

INKJET RECORDING HEAD

BACKGROUND OF THE INVENTION

1. Field of the Invention

The present invention relates to an inkjet recording head that adopts an inkjet recording method for performing recording on a recording medium by discharging ink toward the recording medium.

2. Description of the Related Art

Today, an inkjet recording method can record high definition images at high speed, and perform recording on a recording medium which is not subjected to special treatment. Accordingly, the inkjet recording method is widely used. Various discharge methods are used in an inkjet recording head for realizing the inkjet recording method. For example, a method for discharging ink by applying energy obtained by heating and bubbling the ink, and a method for utilizing piezoelectric elements are typical methods. In the inkjet recording head that adopts these methods, even higher definition and higher quality images have been demanded in recent years. Therefore, the inkjet recording head is required to discharge smaller ink droplets to meet the demand.

However, if a diameter of a discharge port is decreased to discharge the smaller ink droplets, a flow resistance of the discharge port is increased. Therefore, discharge efficiency may be deteriorated. In order to reduce the flow resistance of the discharge port for solving this problem, it is effective in reducing a thickness of an orifice plate.

Reduction of the thickness of the orifice plate is effective in reducing the flow resistance, but is disadvantageous for its strength. In particular, when a material of the orifice plate is resin, the orifice plate itself may be swollen by ink liquid, and may be eventually deformed. Therefore, it is concerned about influence on discharge of the ink droplets.

To solve this problem, it is effective to provide a rib in an orifice plate, as discussed in Japanese Patent Application Laid-Open No. 10-146976. This is because strength against deformation of the orifice plate is improved by providing the rib. As the rib provided in the orifice plate, a configuration for providing the rib with a length longer than a width of an ink flow path near a communication portion between an ink supply port and the ink flow path is known, as discussed in Japanese Patent Application Laid-Open No. 2000-158657. A single continuous rib or a plurality of discontinuous ribs is provided on the ink supply ports along an array direction of electrothermal conversion elements required for discharging the ink.

If an orifice plate is extremely thin, as described above, a structure in which a single continuous rib is provided on the ink supply ports is effective for improving strength of the orifice plate against the deformation, as discussed in Japanese Patent Application Laid-Open No. 2000-158657 . FIG. 11 illustrates a configuration of a conventional inkjet recording head in which a single continuous rib is provided on ink supply ports.

In an inkjet recording head 100 illustrated in FIG. 11, an ink supply port 41 serving as a through-port is formed on a substrate 11, and a rib 61 is provided on a back surface of an orifice plate 71 located on the ink supply port 41. At both sides of the ink supply port 41, discharge energy generating elements 31 for generating discharge energy required for discharging the ink are arranged. Between the discharge energy generating elements 31, coating resin layers 21 serving as ink flow path walls for forming the ink flow paths as nozzles are provided. On the coating resin layer 2, the orifice plate 71 including discharge ports 81 is provided. In the inkjet recording head 100, when a width W of the rib 61 is about 20 to 30 μm, an opening width T of the ink supply port 41 is, normally, 100 to 200 μm, which is enough wider compared with the width W. Therefore, conventionally, even if the opening width T of the ink supply port 41 or a position of the rib 61 with respect to the ink supply port 41 varies by the order of several tens pm during manufacturing, there is little influence on an ink supply.

However, in the above-described inkjet recording head, recently, there is a demand for reduction in size of the substrate for purpose of reduction in cost. Since it is effective in reducing the size of the ink supply port to reduce the cost, there is another demand for making an opening width of the ink supply port smaller than conventional one. When a rib is provided on an ink supply port with a small opening width and if a position of the rib in the orifice plate is displaced from a design position with respect to the ink supply port, an opening area of the ink supply port may become very small. Since flow resistance of the ink increases as the opening area decreases, there is a concern that refilling speed (charging speed of ink to the orifice plate) becomes slower.

Thus, if a plurality of discontinuous ribs is used on the ink supply ports, as discussed in Japanese Patent Application Laid-Open No. 2000-158657, a clearance is created between the ribs, and decrease in the refilling speed can be suppressed compared with the single continuous rib. However, since the ribs are discontinuous, there arises a problem that strength of the orifice plate is deteriorated compared with a conventional continuous structure.

SUMMARY OF THE INVENTION

The present invention is directed to an inkjet recording head that can sufficiently maintain strength of an orifice plate without disturbing discharge of ink, if an opening width of an ink supply port is made small.

According to an aspect of the present invention, a liquid jet recording head includes a substrate including a plurality of discharge energy generating elements, and a plurality of ink supply ports positioned along an array direction of the plurality of discharge energy generating elements and separated from each other by beams, a plurality of ribs supported by the beams, and an orifice plate supported by the plurality of ribs, wherein the orifice plate includes discharge ports for discharging liquid droplets which enter from the plurality of ink supply ports and is provided with discharge energy by the plurality of discharge energy generating elements.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

F*igs*. 3A and 3B illustrate a configuration of a main portion of the inkjet recording head according to the first exemplary embodiment of the present invention.

DESCRIPTION OF THE EMBODIMENTS

Various exemplary embodiments, features, and aspects of the invention will be described in detail below with reference to the drawings.

Figure 1:
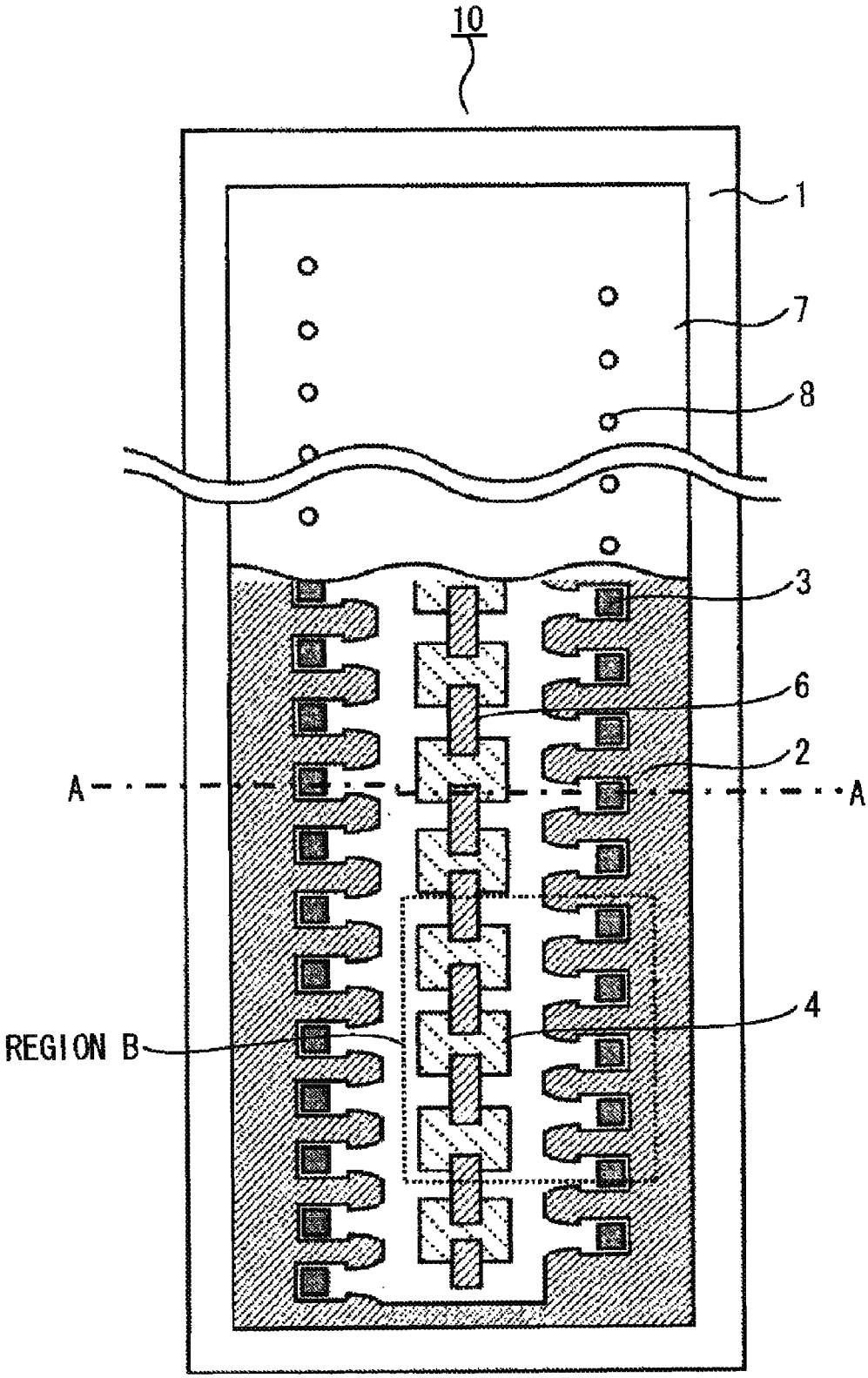
FIG. 1 illustrates a configuration of an inkjet recording head according to a first exemplary embodiment of the present invention.
Figure 2:
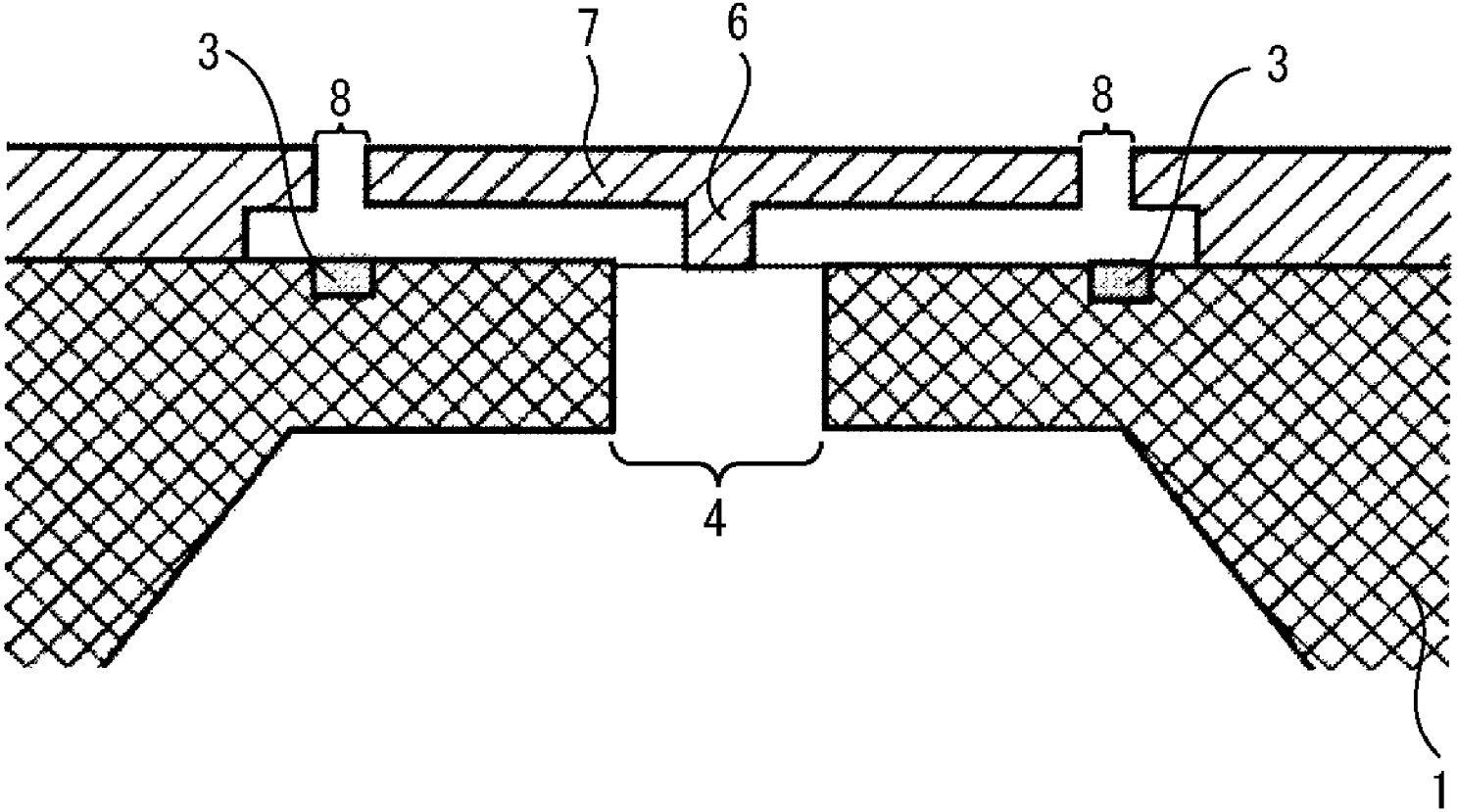
FIG. 2 is a cross-sectional view taken along a cutting-plane line A-A illustrated in FIG. 1.

FIG. 1 illustrates a configuration of a liquid jet recording head (inkjet recording head) according to a first exemplary embodiment of the present invention. FIG. 1 illustrates a state in which a part of the interior thereof is exposed. FIG. 2 is a cross-sectional view taken along a cutting-plane line A-A illustrated in FIG. 1.

As illustrated in FIG. 1, a plurality of ink supply ports 4 serving as through-holes are formed at intervals on a substrate 1 in an inkjet recording head 10 according to the present exemplary embodiment. On both sides of the ink supply ports 4, discharge energy generating elements 3 for generating discharge energy required for discharging liquid (ink) are arranged. Between the discharge energy generating elements 3, a coating resin layer 2 that constitutes an ink flow path walls for forming an ink flow path as a nozzle is provided. On the coating resin layer 2, an orifice plate 7 including discharge ports 8 is provided. In the inkjet recording head 10, the ink that enters from the ink supply ports 4 is supplied discharge energy by the discharge energy generating elements 3, and subsequently ejected from the discharge ports 8 as ink droplets (liquid droplets).

Figure 3A:
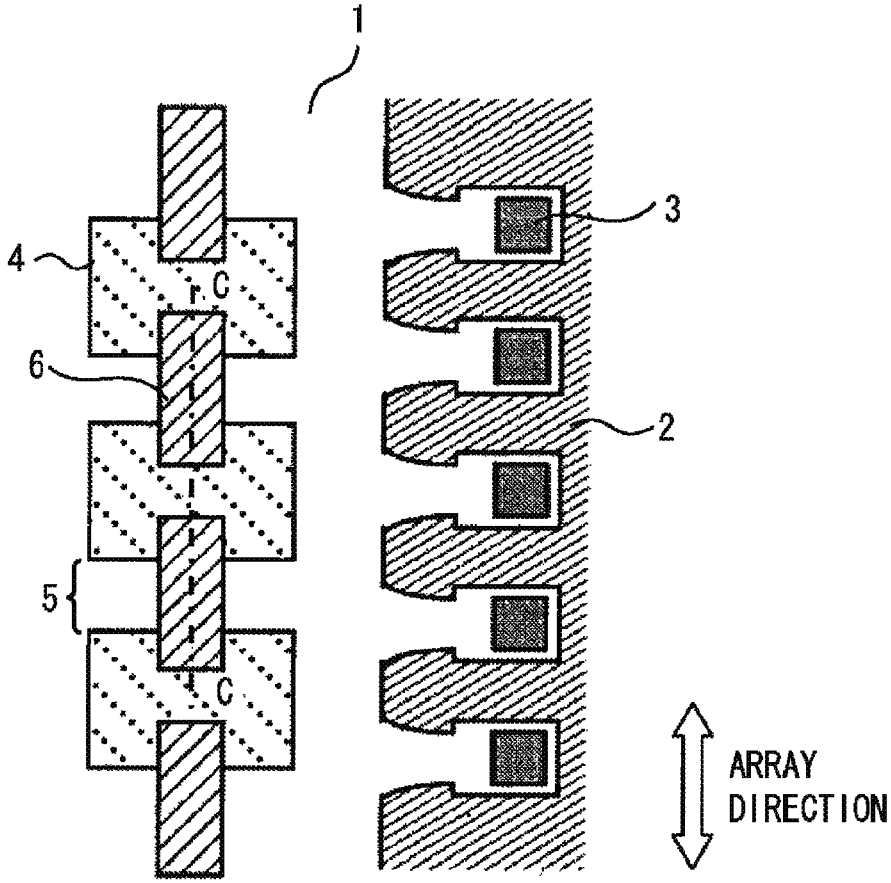
FIG. 3A is an enlarged view of a region B illustrated in FIG. 1.
Figure 3B:
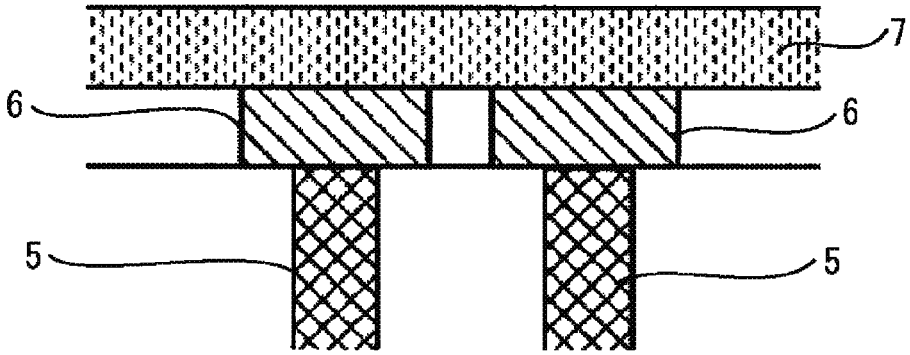
FIG. 3B is a cross-sectional view taken along a cutting-plane line C-C illustrated in FIG. 3A.

FIGS. 3A and 3B illustrate a configuration of a main portion of the inkjet recording head 10. FIG. 3A is an enlarged view of a region B illustrated in FIG. 1. FIG. 3B is a cross-sectional view taken along a cutting-plane line C-C illustrated in FIG. 3A.

In the inkjet recording head 10, as illustrated in FIG. 3A, the plurality of the ink supply ports 4 are separated from each other by beams 5. Further, as illustrated in FIG. 3B, a plurality of ribs 6 are provided on the orifice plate 7, and these ribs 6 are separately supported by the beams 5. The ribs 6, as illustrated in FIG. 3A, are aligned along an array direction of the discharge energy generating elements 3 (hereinafter, referred to as an array direction), and there is a clearance between adjacent ribs.

In a conventional inkjet recording head 100, a single rib 61 is only provided from an orifice plate 71 on a single ink supply port 41 which has a wide opening area, and the rib 61 is not supported. On the other hand, in the inkjet recording head 10 according to the present exemplary embodiment, the plurality of the ribs 6 are respectively supported by the beams 5 located between the ink supply ports 4, so that strength of the orifice plate 7 can be sufficiently maintained.

Figure 4:
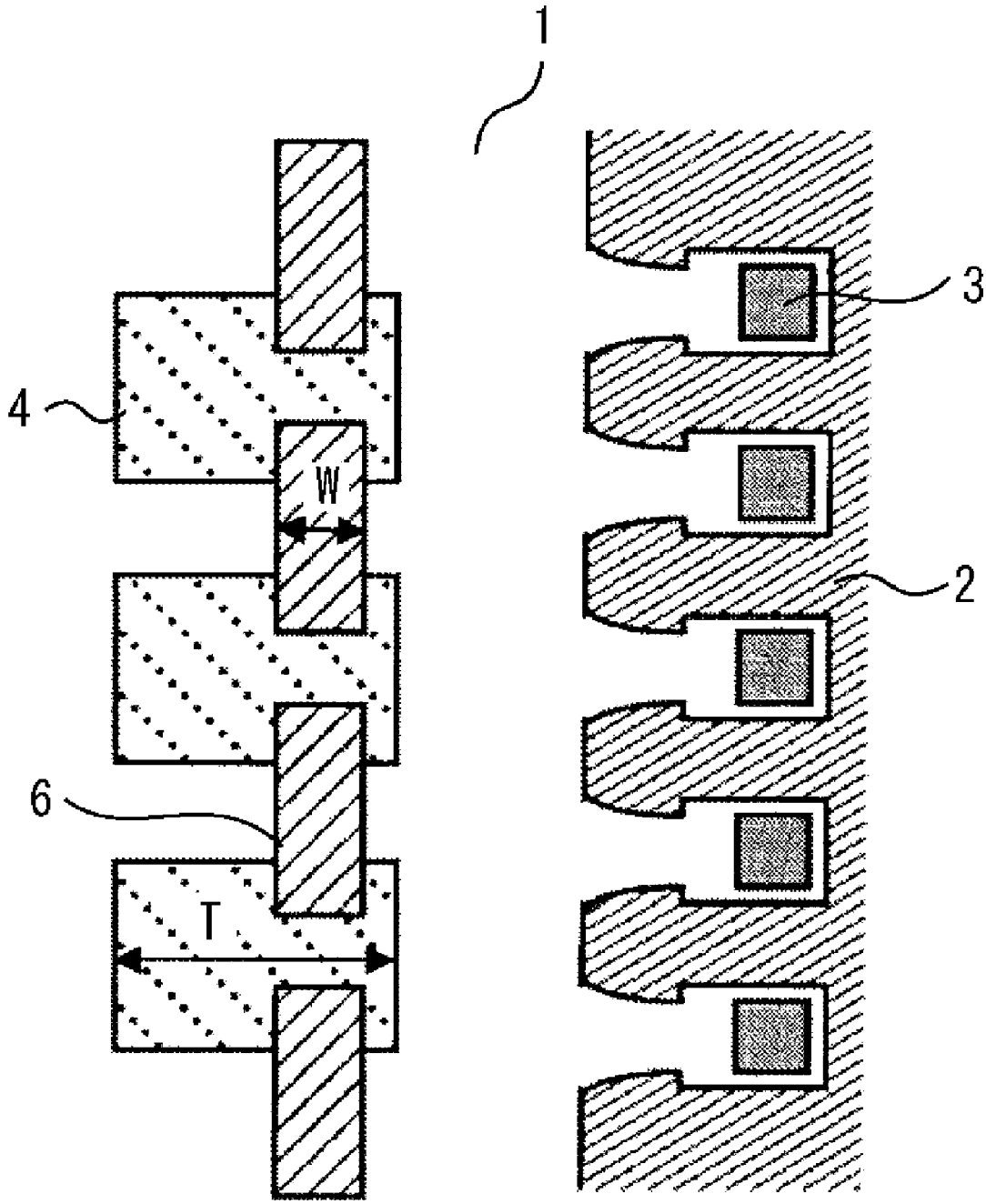
FIG. 4 illustrates an example of a state in which positions of ribs with respect to ink supply ports are displaced during manufacturing.

An effect of the inkjet recording head 10 will be described below with specific numeric values. FIG. 4 illustrates an example in which a position of the ribs 6 with respect to the ink supply ports 4 is displaced during manufacturing.

In FIG. 4, an opening width T of the ink supply ports 4 is 50 to 60 μm, which is smaller than conventional width 100 to 200 μm, and a width W of the ribs 6 is 20 μm. In such a case, when displacement of about 10 μm occurs during the manufacture, an opening area in the conventional continuous rib like the rib 61, will be reduced to approximately ⅓. When the opening area becomes small, flow resistance of the ink increases. As a result, it gives a significant influence on ink supply performance. However, there may be a clearance between the ribs on the ink supply ports 4, like the inkjet recording head 10. In such a case, if the position of the ribs 6 with respect to the ink supply ports 4 is displaced, the ink can flow through the clearance between the ribs, so that influence on the ink supply performance can be reduced. Hence, according to the present exemplary embodiment, the inkjet recording head which has a high yield rate in terms of the manufacture can be provided.

Figure 5:
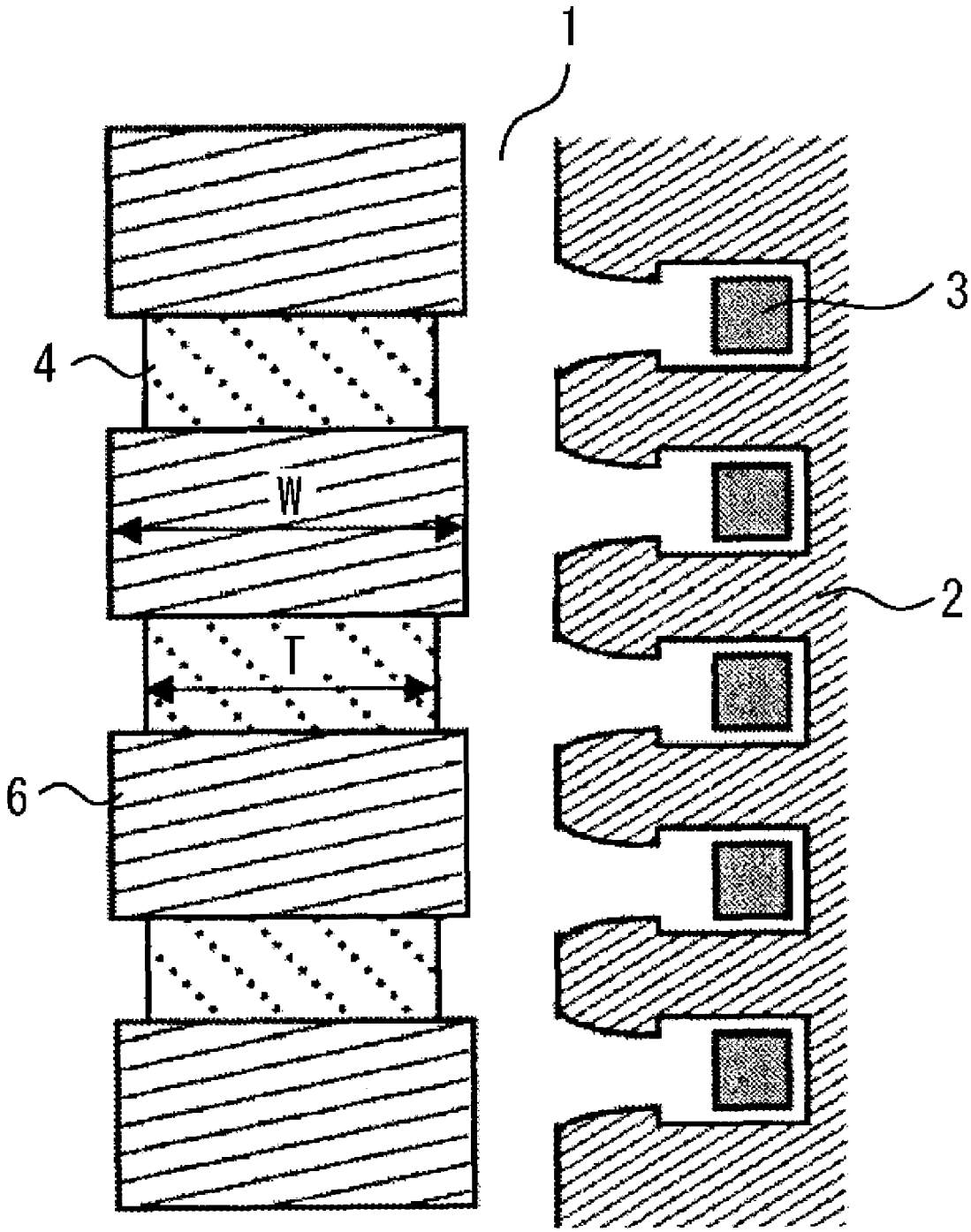
FIG. 5 illustrates an example of a configuration in which widths of the ribs are widened in the inkjet recording head according to the first exemplary embodiment of the present invention.

Further, a configuration in which a width of the rib is widened can be implemented by allowing the above-described positional displacement. In the conventional continuous rib, the width of the rib cannot be widened since it might block the ink supply port. FIG. 5 illustrates an example of a configuration in which the width W of the ribs 6 is wider than the opening width T of the ink supply ports 4 in the inkjet recording head 10. As illustrated in FIG. 5, when the width W is widened, an area that supports the orifice plate 7 increases, so that strength of the orifice plate 7 against deformation is further improved.

Figure 6:
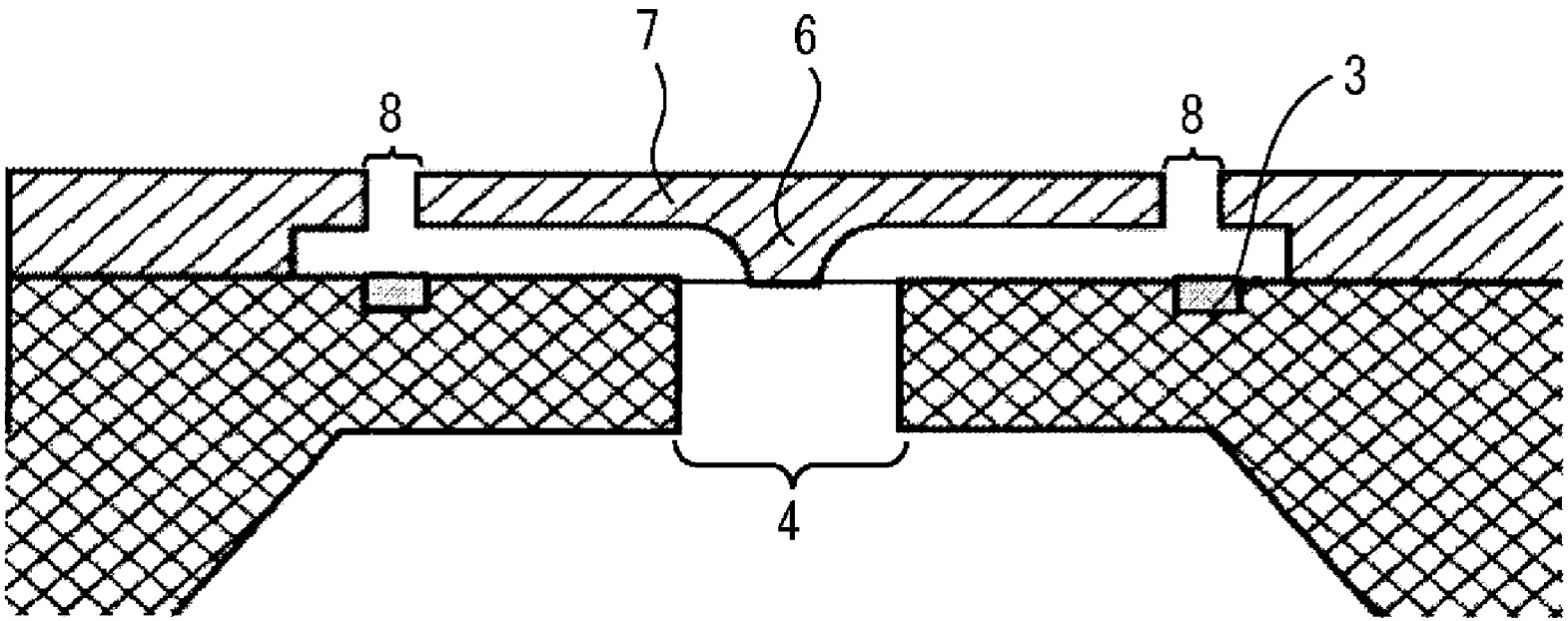
FIG. 6 illustrates an example of a configuration in which a shape of an end portion of the rib bonded to the orifice plate is rounded off in the inkjet recording head according to the first exemplary embodiment of the present invention.

In the present exemplary embodiment, as illustrated in FIG. 6, a cross-sectional shape of an end portion of the rib 6 that is bonded to the orifice plate 7 may be a curved shape represented by R-shape. In this case, stresses applied on the orifice plate 7 and the ribs 6 are distributed, so that the strength of the orifice plate 7 against deformation may be further improved than that of a rectangular cross-sectional shape illustrated in FIG. 2.

Figure 7:
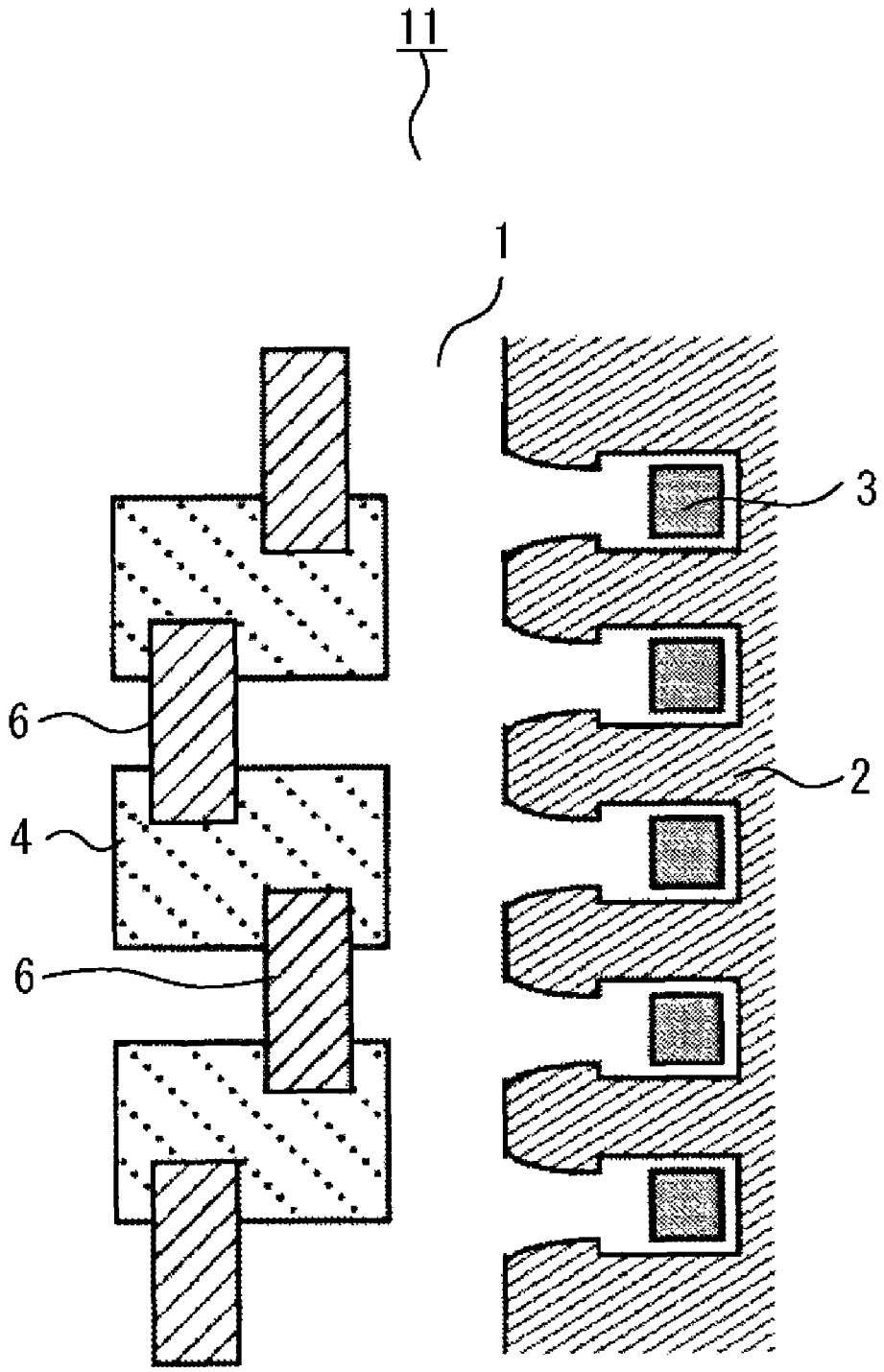
FIG. 7 illustrates a configuration of a main portion of an inkjet recording head according to a second exemplary embodiment of the present invention.

FIG. 7 illustrates a configuration of an inkjet recording head according to a second exemplary embodiment of the present invention. In an inkjet recording head 11 according to the present the exemplary embodiment, arrangement and configuration of ribs 6 are different from those in the inkjet recording head 10 as described in the first exemplary embodiment. FIG. 7, similarly to FIG. 3A, illustrates an enlarged view of a region corresponding to a region B described in FIG. 1.

In the inkjet recording head 11, as illustrated in FIG. 7, the plurality of the ribs 6 are alternately arranged on rows (a first row and a second row) which are spaced apart from each other and extend in parallel with the array direction. More specifically, the plurality of the ribs 6 are arranged and configured such that they are displaced (spaced) in a direction orthogonal to the array direction from a position aligned in a row like the inkjet recording head 10. As a result, a clearance between the adjoining ribs 6 can be widened, so that the ink supply performance is improved.

Figure 8:
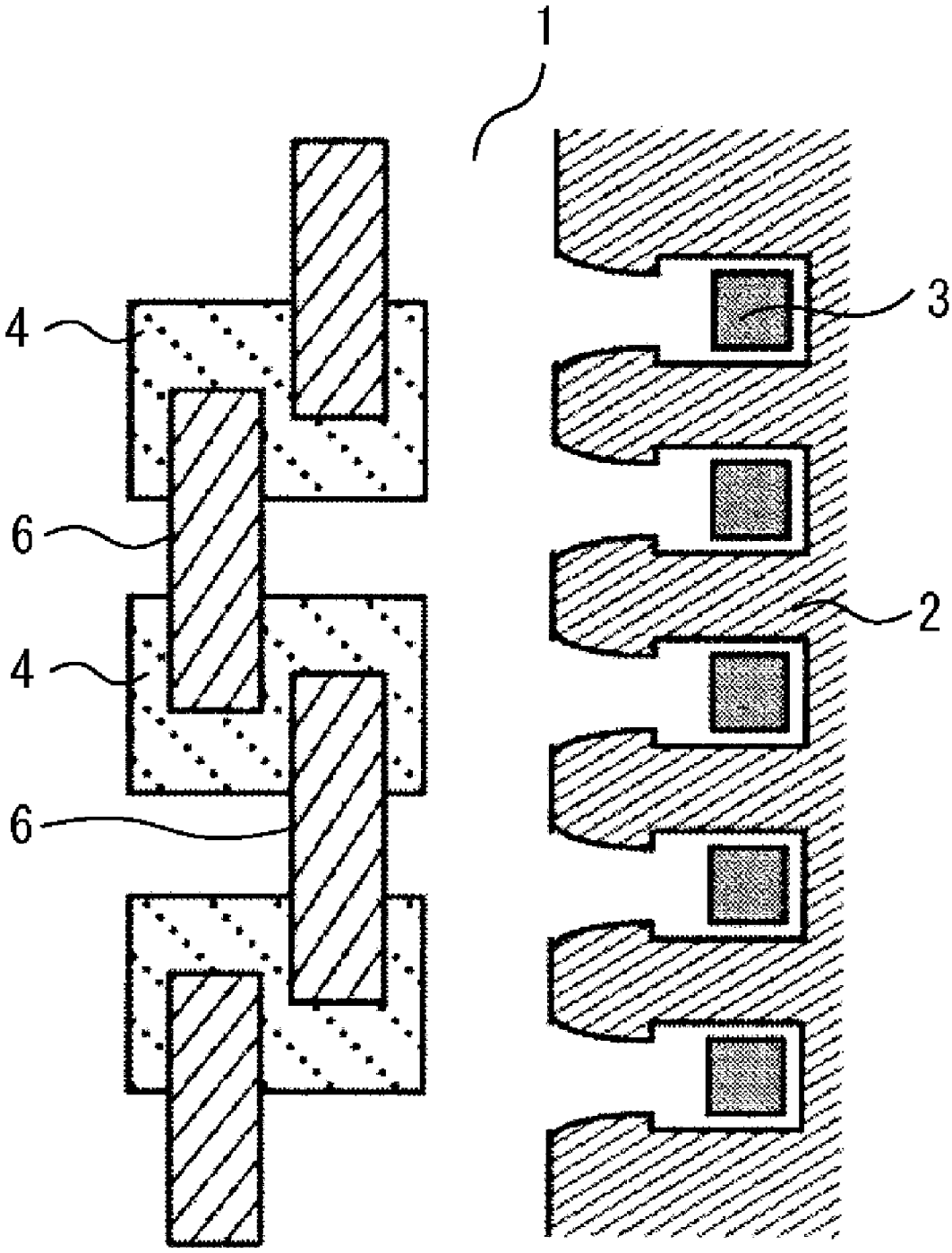
FIG. 8 illustrates an example of a configuration in which lengths of the ribs are lengthened in the inkjet recording head according to the second exemplary embodiment of the present invention.

As illustrated in FIG. 8, a length of the rib 6 can be extended in the array direction to have an overlap (parallel) portion with the adjoining rib 6. In this case, since an area that supports the orifice plate 7 becomes wider compared with the ribs 6 illustrated in FIG. 7, strength of the orifice plate 7 can be further improved. However, if the length of the rib 6 in the array direction becomes such that it extends beyond the ink supply ports 4 adjoining to itself, it gives adverse influence on the ink supply. Therefore, it is desirable that each rib 6, as illustrated in FIG. 8, has portions that are parallel to the adjacent ribs 6, and at the same time, end portions are situated in a halfway position (position not exceed the ink supply ports 4) of the ink supply ports 4. Accordingly, both of the ink supply performance and the strength of the orifice plate can be improved. Further, in the present exemplary embodiment, similarly to the first exemplary embodiment, if the end portions of the rib 6 are curved shape in cross-section, the strength of the orifice plate can be further improved.

Figure 9:
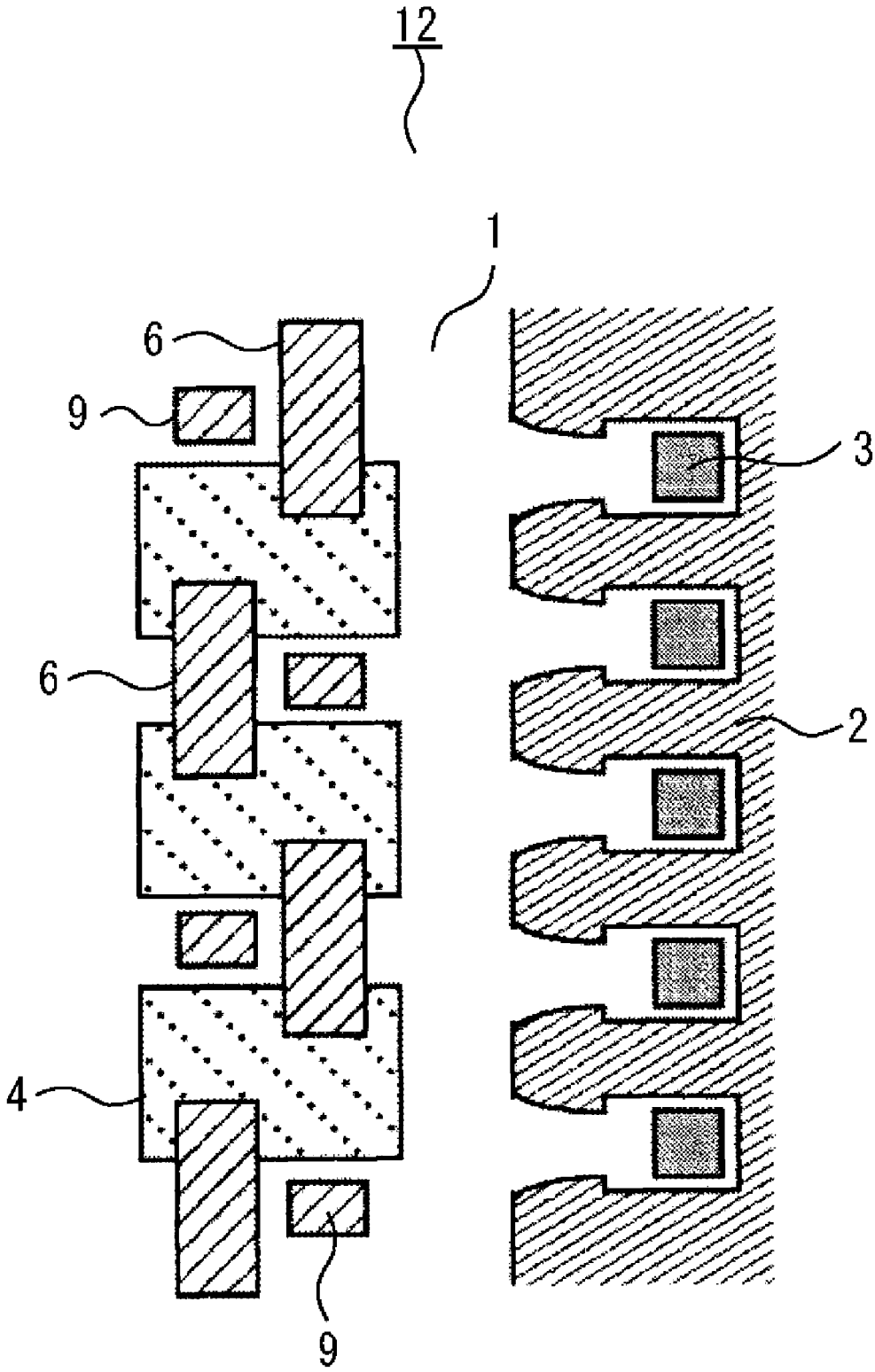
FIG. 9 illustrates a configuration of a main portion of an inkjet recording head according to a third exemplary embodiment of the present invention.

FIG. 9 illustrates a configuration of a main portion of an inkjet recording head according to a third exemplary embodiment of the present invention. An inkjet recording head 12 according to the present exemplary embodiment has different arrangement and configuration of ribs from that of the inkjet recording head 10. FIG. 9, similarly to FIG. 3A, illustrates an enlarged view of a region corresponding to a region B illustrated in FIG. 1.

In the inkjet recording head 12, as illustrated in FIG. 9, similarly to the inkjet recording head 11, the ink supply performance can be improved by arraying a plurality of the ribs 6 in a zigzag pattern on different rows extending in parallel with the array direction. Further, the inkjet recording head 12, as in illustrated in FIG. 9, includes auxiliary ribs 9 which are provided as a configuration for improving strength of the orifice plate 7.

Since the auxiliary rib 9 is supported by the beam 5, strength of the orifice plate 7 is sufficiently improved. Further, a length of the auxiliary rib 9 in the array direction is shorter than a width of the beam 5 in the array direction, and do not extend off the ink supply ports 4. Therefore, influence on the ink supply performance is small.

Figure 10:
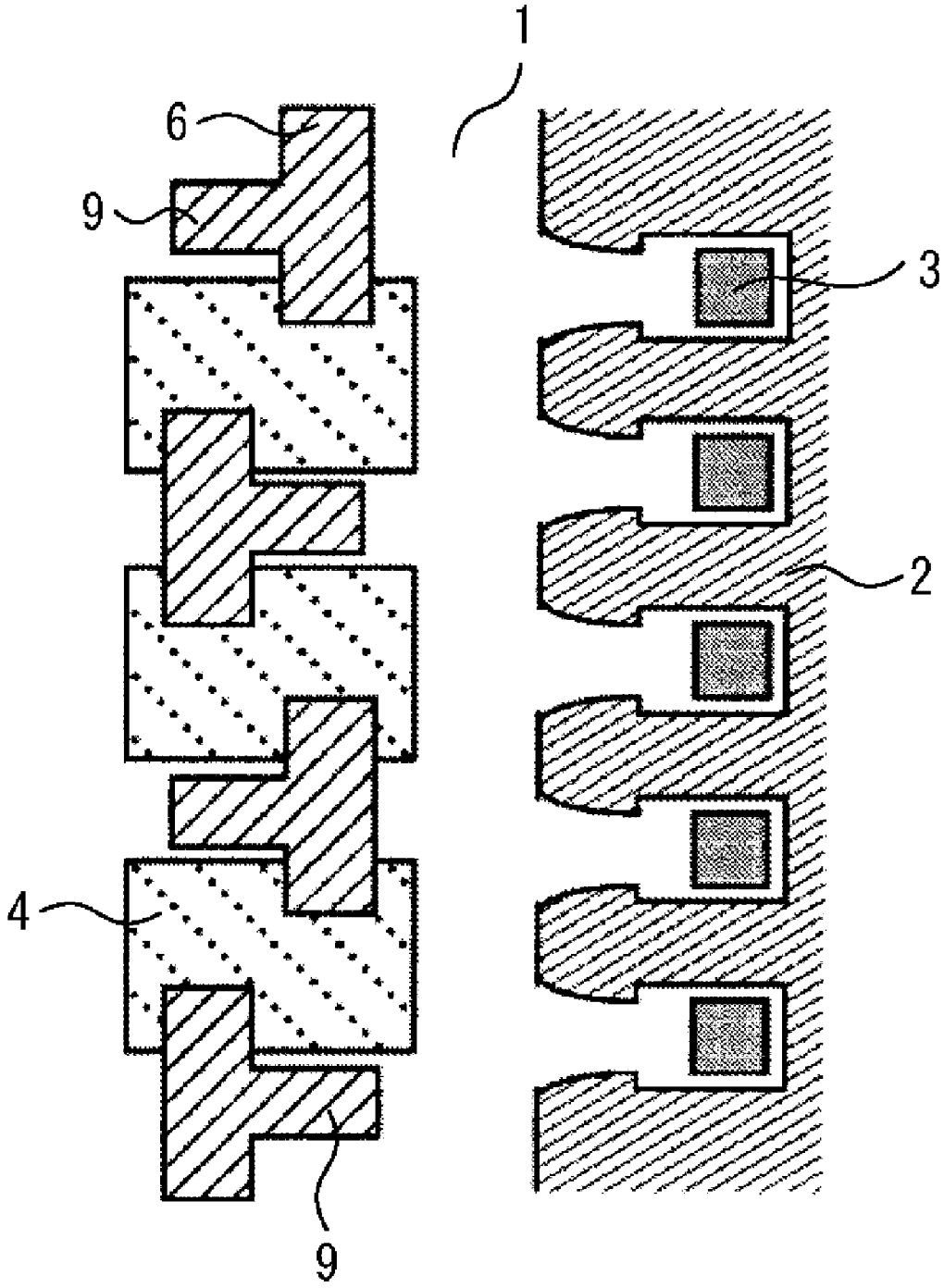
FIG. 10 illustrates an example of a configuration in which two ribs are combined in one piece in the inkjet recording head according to the third exemplary embodiment the present invention.
Figure 11:
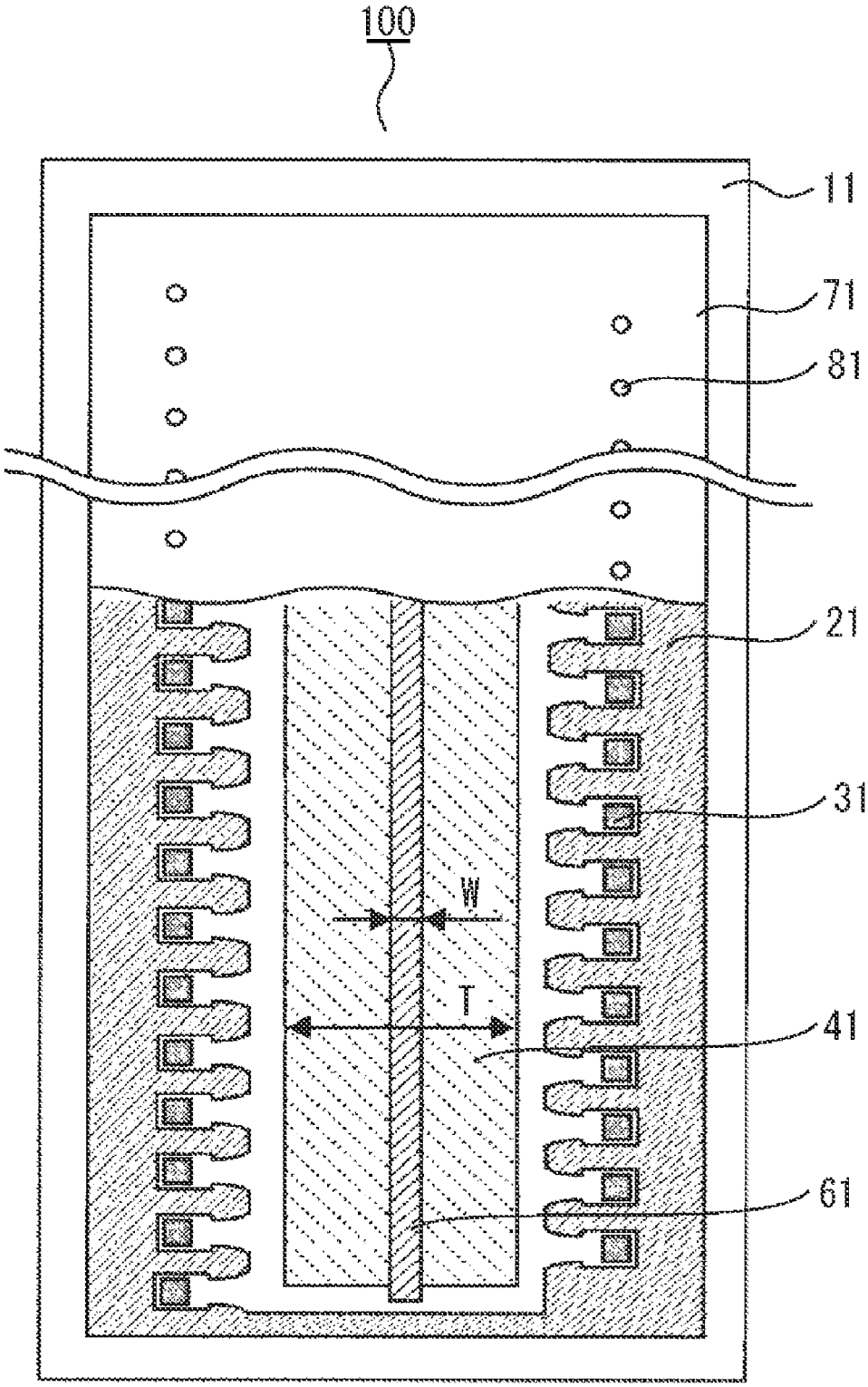
FIG. 11 illustrates a configuration of a conventional inkjet recording head.

The auxiliary ribs 9 may be in pillar-shaped and spaced apart from the ribs 6, as illustrated in FIG. 9, or may be in a shape combined with the ribs 6 in one piece, as illustrated in FIG. 10.

In the present exemplary embodiment, similarly to the first exemplary embodiment and the second exemplary embodiment, if end portions of the ribs 6 are curved-shape, strength of the orifice plate can be further improved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-026005 filed Feb. 6 , 2009, which is hereby incorporated by reference herein in its entirety.

What is claimed is:

1. A liquid jet recording head comprising:

a substrate including a plurality of discharge energy generating elements, and a plurality of ink supply ports positioned along an array direction of the plurality of discharge energy generating elements and separated from each other by a plurality of beams positioned along the array direction;

a plurality of ribs, wherein each rib of the plurality of ribs is supported by a single beam; and an orifice plate supported by the plurality of ribs, wherein the orifice plate includes discharge ports for discharging liquid droplets which enter from the plurality of ink supply ports and is provided with discharge energy by the plurality of discharge energy generating elements.

2. The liquid jet recording head according to claim 1, wherein a length of the plurality of ribs in the array direction is longer than a length of the plurality of beams in the array direction.

3. The liquid jet recording head according to claim 1, wherein end portions of the plurality of ribs in the array direction are positioned within the ink supply ports.

4. The liquid jet recording head according to claim 1, wherein a length of the plurality of ribs in a direction orthogonal to the array direction is longer than a length of the ink supply ports in the orthogonal direction.

5. The liquid jet recording head according to claim 1, wherein the plurality of ribs are alternately positioned, in the array direction, on a first row which extends along the array direction and on a second row which extends along the array direction at positions apart from the first row with respect to a row of the discharge energy generating elements.

6. The liquid jet recording head according to claim 5, further comprising an auxiliary rib which is positioned on the second row in the beam when the rib is positioned on the first row, and is positioned on the first row in the beam when the rib is positioned on the second row, wherein a length of the auxiliary rib in the array direction is shorter than a length of the beam in the array direction.

7. The liquid jet recording head according to claim 6, wherein the auxiliary rib is combined with the rib in one piece.

8. The liquid jet recording head according to claim 1, wherein a portion of the plurality of ribs which is bonded to the orifice plate is curved shape in cross section.

* * * * *